US012566052B2

(12) United States Patent
Sadler et al.

(10) Patent No.: US 12,566,052 B2
(45) Date of Patent: Mar. 3, 2026

(54) MULTIPLE EXPLOSIVELY FORMED PENETRATOR (EFP) WARHEAD

(71) Applicant: Raytheon Company, Arlington, VA (US)

(72) Inventors: Coulton T. Sadler, Tucson, AZ (US); Michael R. Johnson, Tucson, AZ (US); Christopher M. Turner, Oro Valley, AZ (US); Brian J. Lukow, Tucson, AZ (US)

(73) Assignee: Raytheon Company, Arlington, VA (US)

( * ) Notice: Subject to any disclaimer, the term of this patent is extended or adjusted under 35 U.S.C. 154(b) by 0 days.

(21) Appl. No.: 18/742,598

(22) Filed: Jun. 13, 2024

(65) Prior Publication Data

US 2025/0383189 A1 Dec. 18, 2025

(51) Int. Cl.
*F42B 12/10* (2006.01)

(52) U.S. Cl.
CPC ..... *F42B 12/10* (2013.01)

(58) Field of Classification Search
CPC ..... F42B 12/10; F42B 12/02; F42B 12/105; F42B 12/14; F42B 12/16; F42B 12/207; F42B 12/22
USPC ..... 102/476
See application file for complete search history.

(56) References Cited

U.S. PATENT DOCUMENTS 2,494,256 A 1/1950 Morris et al.
2,725,821 A 12/1955 Coleman
2,757,611 A 8/1956 Church et al.
2,763,210 A 9/1956 Church et al.
2,831,429 A 4/1958 Moore
2,856,850 A * 10/1958 Church ..... F42B 1/02 29/421.2

(Continued)

FOREIGN PATENT DOCUMENTS

CN 105389415 B 8/2018
CN 107024149 B 8/2018

(Continued)

OTHER PUBLICATIONS

Fong, Richard, et al., "Multiple Explosively Formed Penetrator (MEFP) Warhead Technology Development", (Dec. 2004), 3 pgs.

(Continued)

*Primary Examiner* — John Cooper
(74) *Attorney, Agent, or Firm* — Schwegman Lundberg & Woessner, P.A.

(57) ABSTRACT

In a MEFP warhead detonation of the main charge is controlled to provide elevated pressure at multiple locations on the back surface of the liner to cut the liner and to form and propel forward a plurality of EFPs. An initiation system is configured for multi-point initiation of a plurality of booster charges to detonate the main charge to produce a plurality of detonation waves that constructively interfere at multiple locations on the back surface of the liner to form pressure hot spots that cut the liner and to form and propel forward a plurality of EFPs. In different embodiments, the elevated pressures are between 110% and 200% of the detonation pressure at the front of an individual detonation wave. The liner may, for example, be a flat plate or a include a plurality of dimples in which case the boosters are aligned to the center of the dimples.

19 Claims, 11 Drawing Sheets

(56) References Cited

U.S. PATENT DOCUMENTS

| | | | | |
|---|---|---|---|---|
| 2,984,307 | A | 5/1961 | Barnes | |
| 3,145,656 | A | 8/1964 | Cook et al. | |
| 3,241,488 | A | 3/1966 | Glass | |
| 3,244,102 | A | 4/1966 | Wofford, III et al. | |
| 3,347,164 | A | 10/1967 | Baks et al. | |
| 3,443,518 | A | 5/1969 | Cross | |
| 3,477,372 | A | 11/1969 | Mcferrin et al. | |
| 3,490,372 | A | 1/1970 | Lavine | |
| 3,613,579 | A | 10/1971 | Wales | |
| 3,847,080 | A | 11/1974 | Eckels | |
| 3,902,422 | A | 9/1975 | Coursen | |
| 3,974,771 | A | 8/1976 | Thomanek | |
| 3,978,796 | A * | 9/1976 | Hackman | F42B 12/14 102/495 |
| 4,018,163 | A | 4/1977 | Brown | |
| 4,043,266 | A | 8/1977 | Held | |
| 4,160,415 | A | 7/1979 | Cole | |
| 4,406,226 | A | 9/1983 | Davitt et al. | |
| 4,499,830 | A | 2/1985 | Majerus et al. | |
| 4,510,870 | A | 4/1985 | Walters | |
| 4,516,501 | A * | 5/1985 | Held | F42B 12/22 102/493 |
| 4,649,828 | A | 3/1987 | Henderson et al. | |
| 4,770,097 | A | 9/1988 | Wilson et al. | |
| 4,823,701 | A | 4/1989 | Wilhelm | |
| 4,892,039 | A | 1/1990 | Emerson et al. | |
| 4,896,609 | A | 1/1990 | Betts et al. | |
| 4,915,029 | A | 4/1990 | Appledorn et al. | |
| 4,960,171 | A | 10/1990 | Parrott et al. | |
| 5,038,683 | A | 8/1991 | Baker et al. | |
| 5,229,542 | A | 7/1993 | Bryan et al. | |
| 5,320,044 | A | 6/1994 | Walters | |
| 5,359,935 | A | 11/1994 | Willett | |
| 5,479,860 | A | 1/1996 | Ellis | |
| 5,531,164 | A | 7/1996 | Mosley | |
| 5,540,156 | A | 7/1996 | Fong | |
| 5,700,969 | A | 12/1997 | Mosley | |
| 5,714,712 | A | 2/1998 | Ewick et al. | |
| 5,939,663 | A * | 8/1999 | Walters | F42C 19/095 102/306 |
| 6,155,155 | A | 12/2000 | Moshier | |
| 6,186,070 | B1 | 2/2001 | Fong et al. | |
| 6,220,167 | B1 | 4/2001 | Yamamoto et al. | |
| 6,393,991 | B1 * | 5/2002 | Funston | F42B 1/032 102/306 |
| 6,457,416 | B1 | 10/2002 | Micke et al. | |
| 6,494,139 | B1 | 12/2002 | Powell | |
| 6,505,559 | B1 | 1/2003 | Joslin et al. | |
| 6,510,797 | B1 | 1/2003 | Fong | |
| 6,606,951 | B1 | 8/2003 | Klein | |
| 6,772,105 | B1 | 8/2004 | Heck, Sr. | |
| 7,047,886 | B2 | 5/2006 | Micke et al. | |
| 7,418,373 | B2 | 8/2008 | Heck, Sr. | |
| 7,658,150 | B2 * | 2/2010 | Ronn | F42B 1/02 102/306 |
| 7,661,367 | B2 | 2/2010 | Yang et al. | |
| 7,913,758 | B2 | 3/2011 | Wheller et al. | |
| 8,127,686 | B2 | 3/2012 | Lloyd | |
| 8,380,436 | B2 | 2/2013 | Heck, Sr. | |
| 8,393,393 | B2 | 3/2013 | Rodgers et al. | |
| 8,397,800 | B2 | 3/2013 | Rodgers et al. | |
| 8,397,814 | B2 | 3/2013 | Rodgers et al. | |
| 8,408,286 | B2 | 4/2013 | Rodgers et al. | |
| 8,418,623 | B2 | 4/2013 | Lloyd | |
| 8,490,686 | B2 | 7/2013 | Rodgers et al. | |
| 8,538,698 | B2 | 9/2013 | Heck, Sr. | |
| 8,714,251 | B2 | 5/2014 | Glenn et al. | |
| 8,714,252 | B2 | 5/2014 | Glenn et al. | |
| 8,875,796 | B2 | 11/2014 | Hales et al. | |
| 8,881,816 | B2 | 11/2014 | Glenn et al. | |
| 8,899,320 | B2 | 12/2014 | Le | |
| 8,978,749 | B2 | 3/2015 | Rodgers et al. | |
| 8,978,817 | B2 | 3/2015 | Rodgers et al. | |
| 8,985,200 | B2 | 3/2015 | Rodgers et al. | |
| 9,091,152 | B2 | 7/2015 | Rodgers et al. | |
| 9,206,675 | B2 | 12/2015 | Hales et al. | |
| 9,297,228 | B2 | 3/2016 | Martinez et al. | |
| 9,428,979 | B2 | 8/2016 | Bell et al. | |
| 9,447,678 | B2 | 9/2016 | Walter et al. | |
| 9,598,940 | B2 | 3/2017 | Rodgers et al. | |
| 9,909,408 | B2 | 3/2018 | Rodgers et al. | |
| 9,926,777 | B2 | 3/2018 | Rodgers et al. | |
| 9,995,562 | B2 | 6/2018 | Jennett et al. | |
| 10,000,994 | B1 | 6/2018 | Sites | |
| 10,443,361 | B2 | 10/2019 | Sites | |
| 10,458,761 | B2 | 10/2019 | Collier | |
| 2005/0126420 | A1 | 6/2005 | Givens et al. | |
| 2007/0240599 | A1 | 10/2007 | Pratt et al. | |
| 2007/0263759 | A1 | 11/2007 | Melin et al. | |
| 2018/0252507 | A1 | 9/2018 | Collier | |
| 2022/0154559 | A1 | 5/2022 | Sadler et al. | |
| 2024/0361110 | A1 | 10/2024 | Sadler et al. | |

FOREIGN PATENT DOCUMENTS

| | | | |
|---|---|---|---|
| CN | 111964545 | A | 11/2020 |
| EP | 3167147 | B1 | 1/2020 |
| FR | 1328393 | A | 5/1963 |
| WO | WO-9951932 | A2 | 10/1999 |

OTHER PUBLICATIONS

Liu, Jie, et al., "A study on the surface overpressure distribution and formation of a double curvature liner under a two-point initiation", Defence Technology, vol. 18, Issue 1, (Jan. 2022), 148-157.

"U.S. Appl. No. 18/742,564, Non Final Office Action mailed May 28, 2025", 18 pgs.

"U.S. Appl. No. 18/742,564, Notice of Allowance mailed Oct. 8, 2025", 8 pgs.

"U.S. Appl. No. 18/742,564, Response filed Aug. 28, 2025 to Non Final Office Action mailed May 28, 2025", 9 pgs.

* cited by examiner

DETONATION WAVES IMPACT DIMPLED LINER

INCREASED CONSTRUCTIVE INTERFERENCE OF DETONATION WAVES

EFPS FORM

DETONATION WAVES INDEPENDENTLY ACCELERATE EFPS

MULTIPLE EXPLOSIVELY FORMED PENETRATOR (EFP) WARHEAD

BACKGROUND

Field

This disclosure relates to a multiple Explosively Formed Penetrator (EFP) Warhead.

Description of the Related Art

Shape-forming charges are explosive charges shaped to focus the effect of the explosive's energy in specific direction and are purely kinetic in nature. A shape-forming charge is composed of two major components: an explosive charge and a metal liner on a forward surface of the explosive charge. Shape-forming charges may be used to penetrator armor, punch holes in naval vessels such as surface ships or submarines or to perforate wells in the oil and gas industry.

One type of shape-forming charge is referred to as an explosively formed penetrator (EFP). Detonation of the explosive charge causes the metal liner to fold, forward or backward, into a single coherent penetrator that is accelerated to extremely high velocities. The liner can generate a number of distinct penetrator forms, depending on the shape and thickness of the liner and how the main explosive is detonated. For example, a liner may be "dish-shaped" with a shallow curvature having an "apex angle" (defined about the axis of the warhead) of suitably 150°-170°. If the apex angle becomes less than approximately 150°, the liner may be formed into another type of shape-forming charge referred to as a shaped charge jet (SCJ). Formation of the penetrator is approximately 100% mass efficient (at least 90%).

A central detonator, array of detonators or detonation waveguide shape the detonation wave(s) into a plane wave that strikes the metal liner to form the single coherent penetrator. The enormous pressure at the front of the plane wave generated by the detonation of the explosive drives the liner in the hollow cavity inward to collapse upon its central axis to project the penetrator forward along the axis.

In addition to single-penetrator EFPs (SEFPs), there are EFP warheads whose liners are designed to produce multiple penetrators; these are known as multiple EFPs or MEFPs. The liner of an MEFP generally comprises a plurality of "dimples" that intersect each other at sharp angles. Upon detonation and formation of the planar wave, the liner fragments along these intersections to form up to dozens of small, generally spheroidal projectiles, producing an effect similar to that of a shotgun. The pattern of impacts on a target can be finely controlled based on the design of the liner and the manner in which the explosive charge is detonated.

SUMMARY

The following is a summary that provides a basic understanding of some aspects of the disclosure. This summary is not intended to identify key or critical elements of the disclosure or to delineate the scope of the disclosure. Its sole purpose is to present some concepts of the disclosure in a simplified form as a prelude to the more detailed description and the defining claims that are presented later.

The present disclosure provides a multiple EFP (MEFP) warhead in which detonation of the main charge is controlled to provide elevated pressure at multiple locations on the back surface of the liner to cut the liner and to form and propel forward a plurality of EFPs.

In an embodiment, a warhead includes a liner on a top surface of a main charge and a plurality of booster charges spaced apart on a bottom surface of the main charge. An initiation system is configured for multi-point initiation of the plurality of booster charges to detonate the main charge to produce a plurality of detonation waves that constructively interfere at multiple locations on the back surface of the liner to cut the liner and to form and propel forward a plurality of EFPs. In different embodiments, the elevated pressures are between 110% and 200% of the detonation pressure at the front of an individual detonation wave.

In an embodiment, pairs of directly adjacent detonation waves produce the multiple locations in a non-planar wave within a defined distance range from the plurality of booster charges. The liner is positioned within that range. Short of that range adjacent detonation waves do not interfere sufficiently to form the elevated pressure location and beyond that range interference of the plurality of detonation waves forms a planar wave. Within this "range", the warhead (liner, main charge, boosters and initiation system) has a height H1 along the axis and a diameter D1 across the axis, wherein $0.3 <= H1/D1 <= 0.6$. By comparison, typical SEFP and MEFP that form a planar wave have a ratio >1.

In an embodiment, the liner is formed with a plurality of dimples. The plurality of booster charges are aligned to the centers of the dimples such that each dimple is cut and formed into an EFP. Suitably, each dimple is thicker in the center and thinner towards the edges to encourage formation of each EFP. Each EFP is stable in-flight over a range to target of at least 50× the diameter of the dimple. The main charge has a height H2 along the axis and a dimple diameter D2 across the axis, wherein $0.5 <= H2/D2 <= 1.5$.

In an embodiment, the liner is formed as a flat plate. The flat plate suitably has uniform thickness across the surface of the main charge.

In different embodiments, the plurality of booster charges may be indirectly detonated from a single point detonator or directly detonated by a plurality of individual detonators. The booster charges may be detonated simultaneously or in a timing pattern to control the formation of individual EFPs and the pattern of EFPs.

In an embodiment, the initiation system includes an inert housing having a single point initiation site and a plurality of tracks that connect the single point initiation site to the plurality of booster charges. Explosive material is placed in the plurality of tracks. A detonator at the single point initiation site produces detonation waves that travel through the explosive material in the tracks to initiate the plurality of booster charges. The plurality of tracks may be equal length to facilitate simultaneous initiation of the plurality of booster charges or different lengths to facilitate a patterned initiation of the plurality of booster charges.

In different embodiments, the warhead and explosive charges may have different geometries such as cylindrical or spherical.

These and other features and advantages of the disclosure will be apparent to those skilled in the art from the following detailed description of preferred embodiments, taken together with the accompanying drawings, in which:

DETAILED DESCRIPTION

Figure 1A:
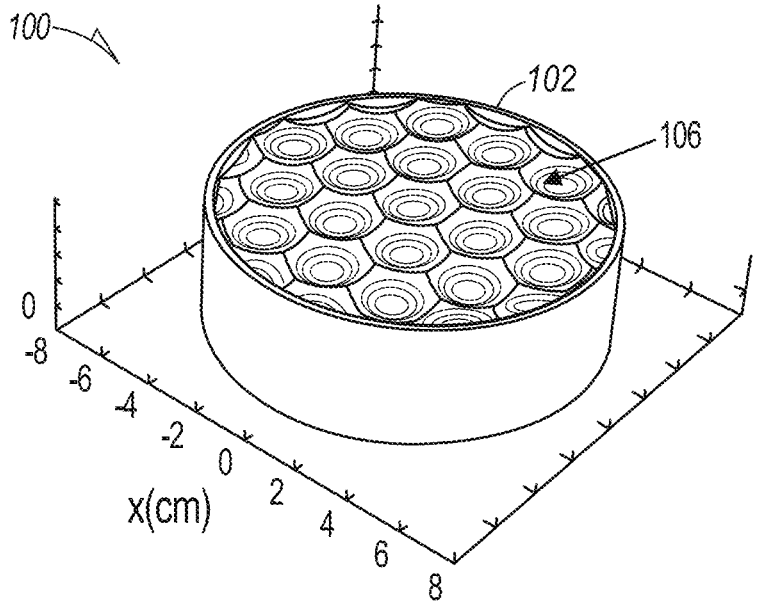
FIGS. 1A-1C are different views of an embodiment of a multiple (EFP) warhead in which the liner is dimpled.
Figure 1B:
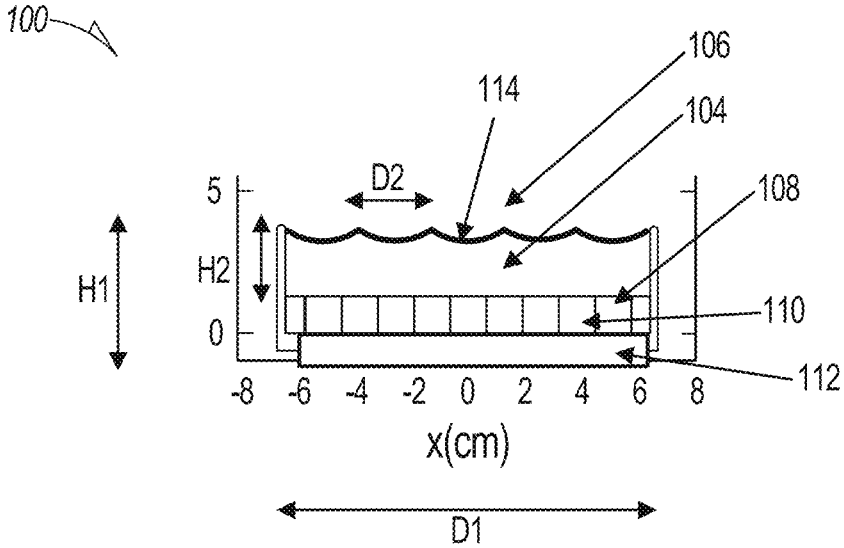
Figure 1C:
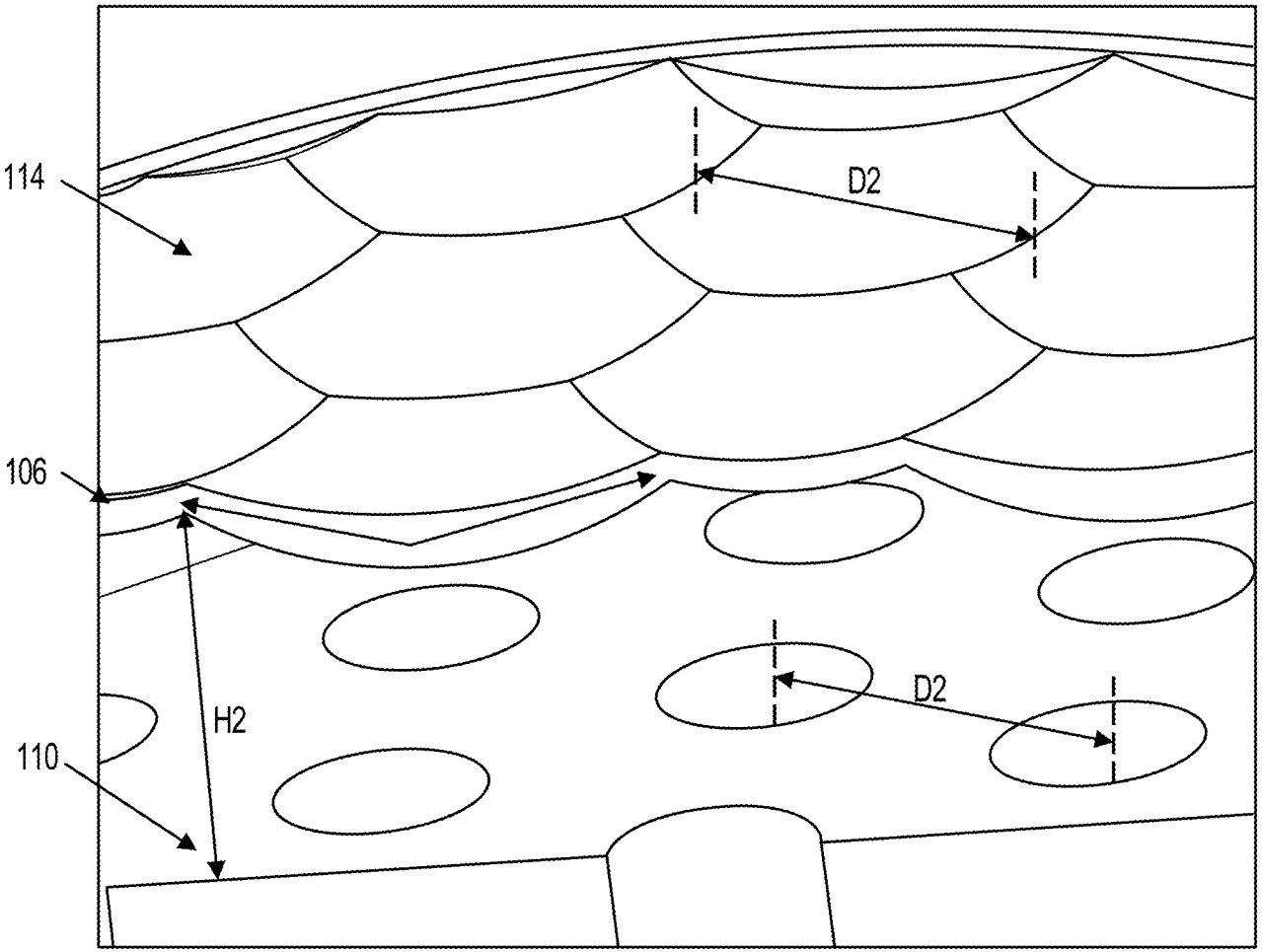
Figure 2:
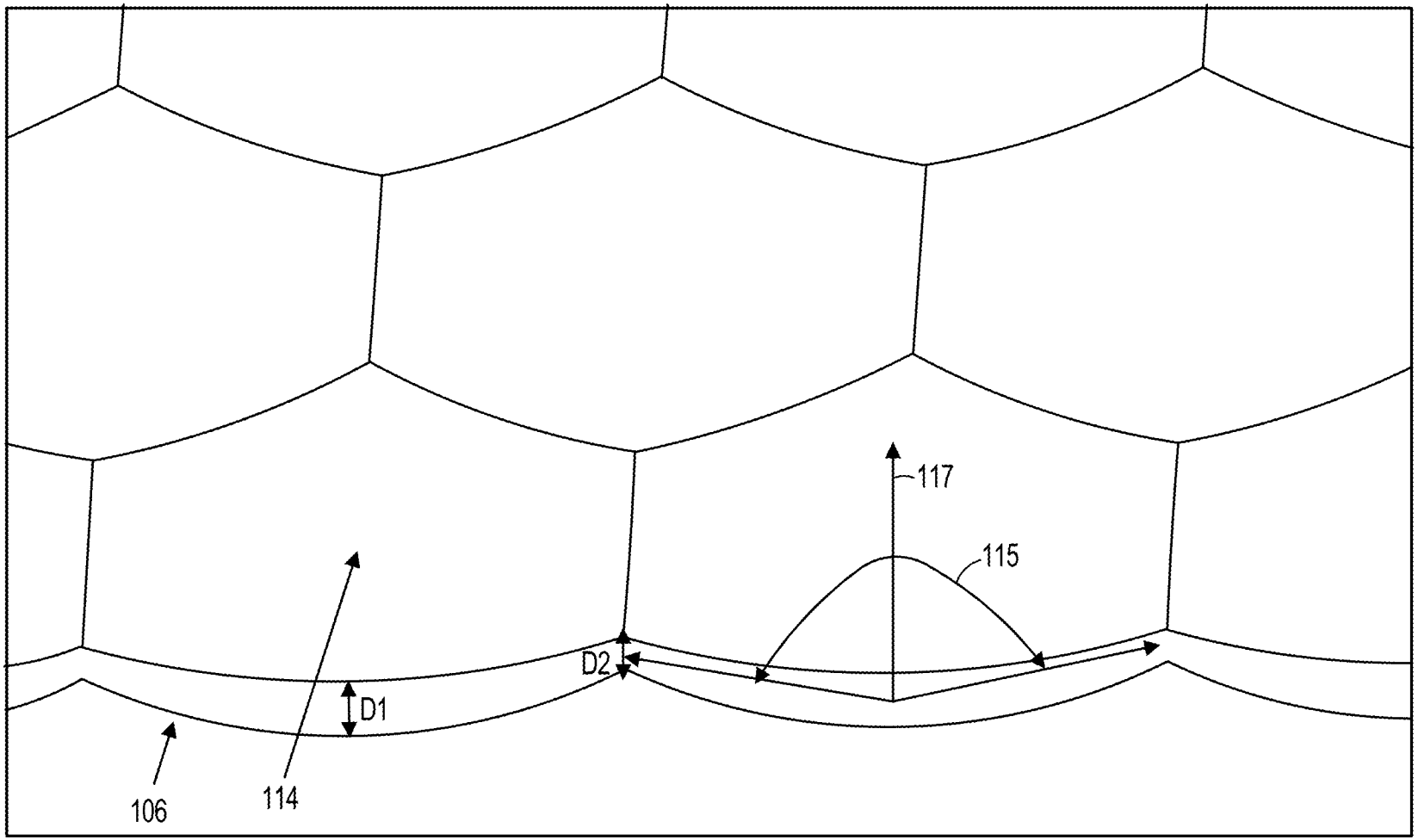
FIG. 2 is a view of an embodiment of a dimpled liner in which each dimple is thicker in the center and thinner towards the edges to form the penetrator.

The present disclosure provides a multiple EFP (MEFP) warhead in which detonation of the main charge is controlled to provide elevated pressure at multiple locations on the back surface of the liner to cut the liner and to form and propel forward a plurality of EFPs.

Referring now to FIGS. 1A-1C and 2, an embodiment of a multiple EFP warhead 100 includes a cylindrical housing 102 that contains a main charge 104, a liner 106 on a top surface of the main charge, a plurality of booster charges 108 in a booster housing 110 and spaced apart on a bottom surface of the main charge, and an initiation system 112. In this embodiment, liner 106 includes a plurality of dimples 114 (e.g., a depression or indentation in the surface of the liner). The apex angle 115 is suitably 150°-170° about an axis 117 of the warhead. Each dimple 114 is suitably thicker d1 at its center than at its edges d2 to better form a penetrator. Booster charges 108 are aligned to the center of the dimples 114. Initiation system 112 is configured for multi-point initiation of the plurality of booster charges 108 to detonate the main charge 104 to produce a plurality of detonation waves that constructively interfere at multiple locations on the back surface of the liner to cut the liner and to form and propel forward a plurality of (EFPs). The elevated pressures at the multiple locations are between 110% and 200% of the detonation pressure at the front of an individual detonation wave.

Pairs of directly adjacent detonation waves produce the multiple locations in a non-planar wave within a defined distance range from the plurality of booster charges. The liner is positioned within that range. Short of that range adjacent detonation waves do not interfere sufficiently to form the elevated pressure location and beyond that range interference of the plurality of detonation waves forms a planar wave. Within this "range", the warhead (liner, main charge, boosters and initiation system) has a height H1 along the axis and a diameter D1 across the axis, wherein $0.3 <= H1/D1 <= 0.6$. By comparison, typical SEFP and MEFP that form a planar wave have a ratio >1. Each EFP is stable in-flight over a range to target of at least 50× the diameter of the dimple. The main charge has a height H2 along the axis and a dimple diameter D2 across the axis, wherein $0.5 <= H2/D2 <= 1.5$.

The plurality of booster charges may be indirectly detonated from a single point detonator or directly detonated by a plurality of individual detonators. The booster charges may be detonated simultaneously or in a timing pattern to control the formation of individual EFPs and the pattern of EFPs.

Figure 3A:
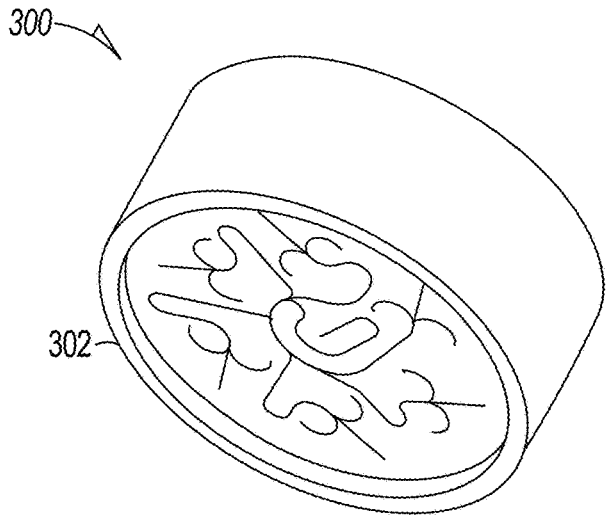
FIGS. 3A-3B are different views of an embodiment of a multi-point initiation system for the multiple EFP warhead.
Figure 3B:
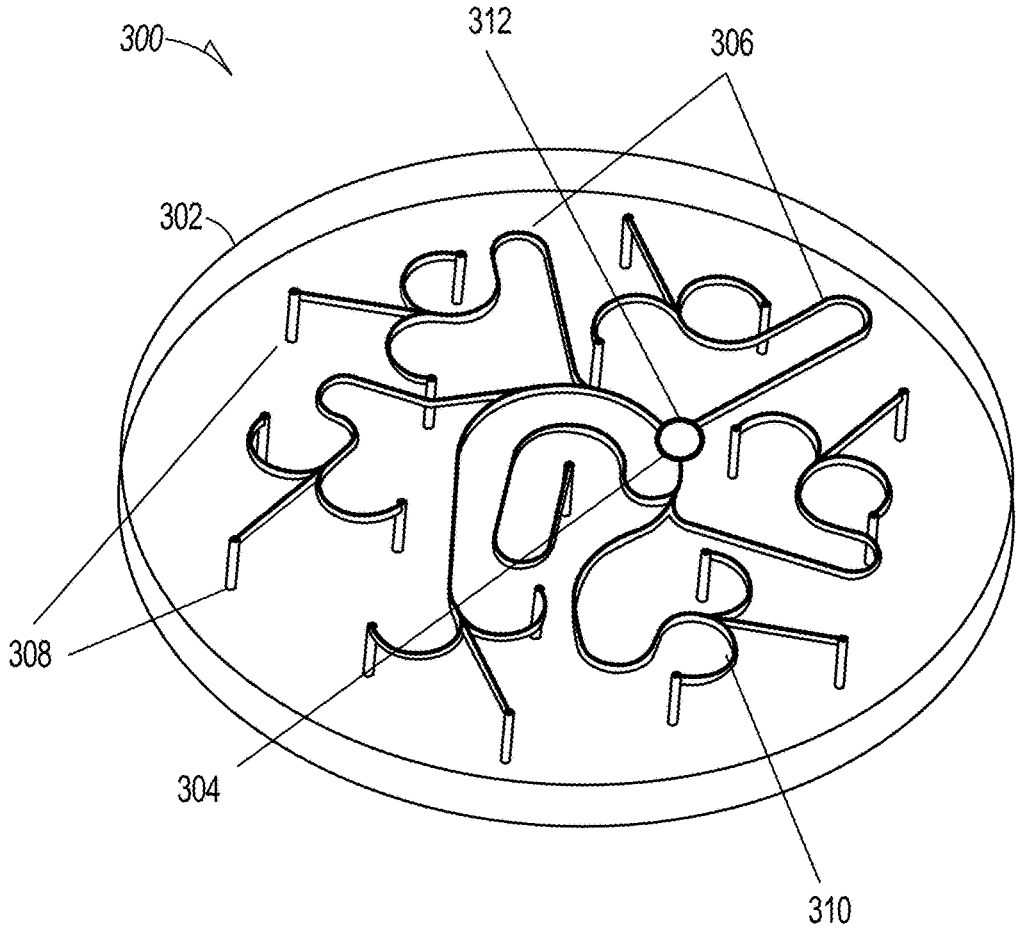
Figure 4B:
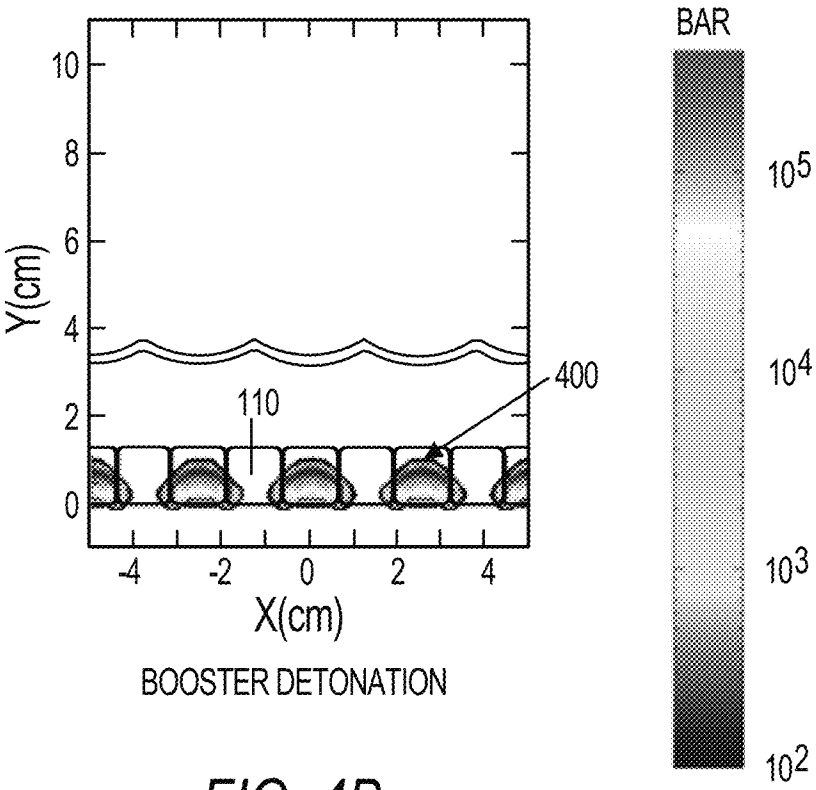
FIGS. 4A-4J are a time-series of plots illustrating a detonation sequence to form and propel multiple EFPs.
Figure 4A:
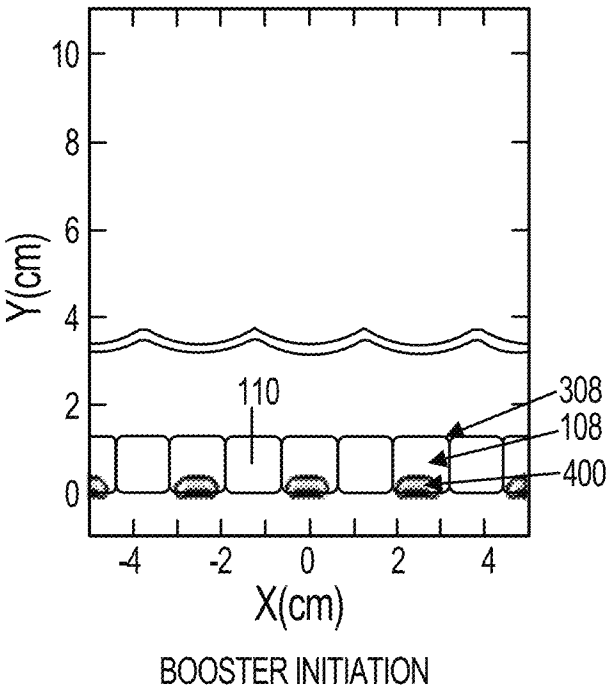
Figure 4D:
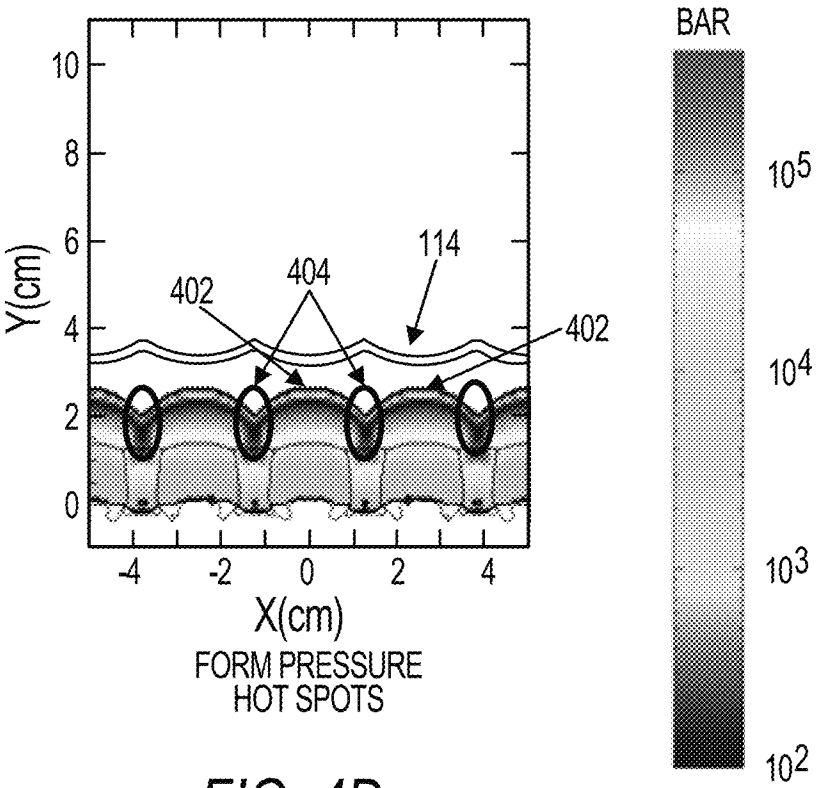
Figure 4C:
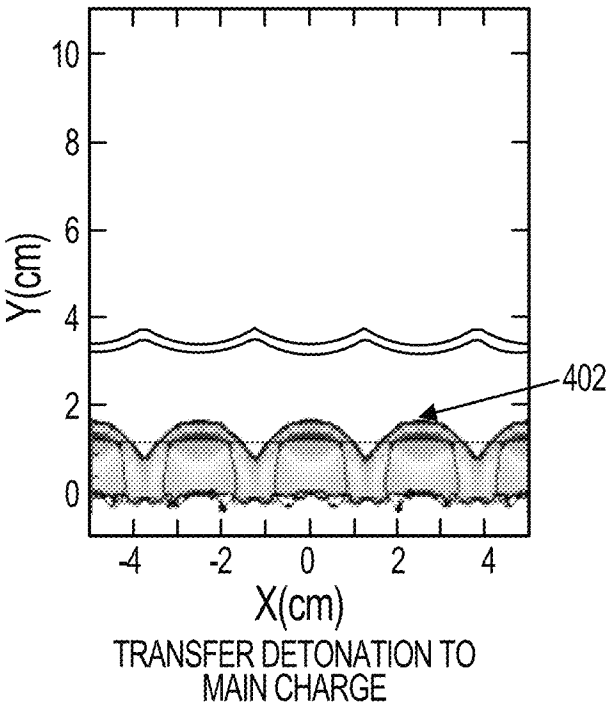
Figure 4F:
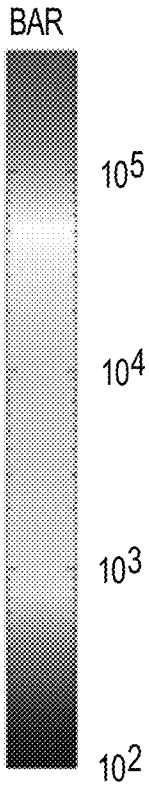
Figure 4F:
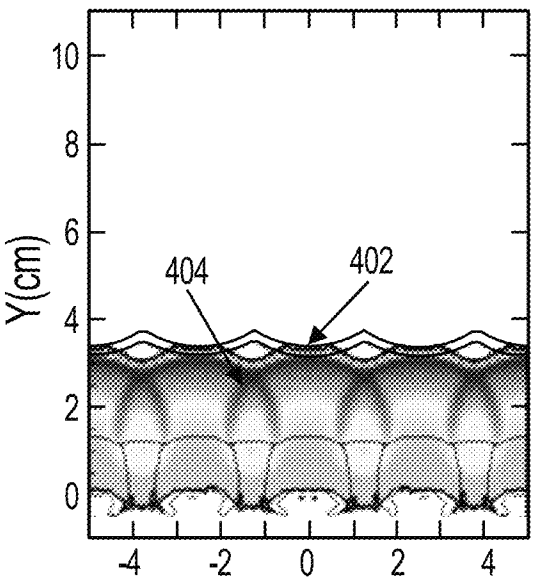
Figure 4E:
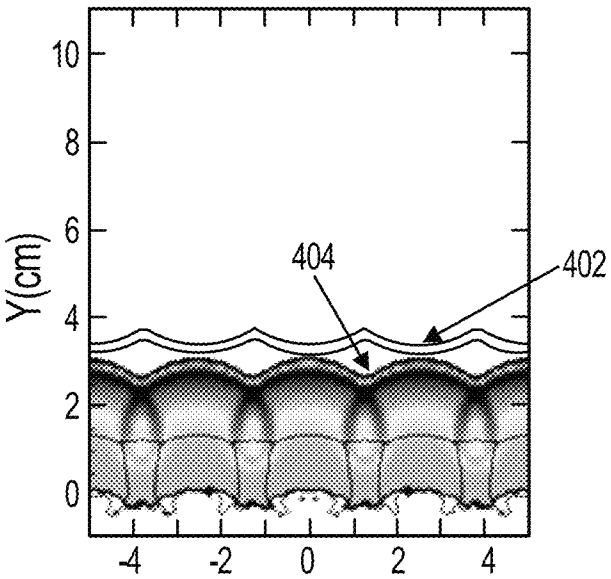
Figure 4H:
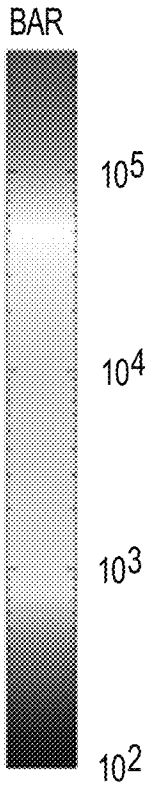
Figure 4H:
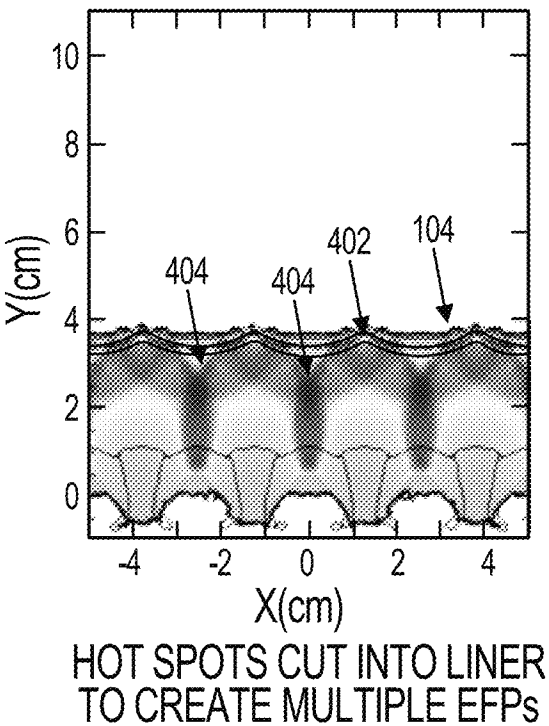
Figure 4G:
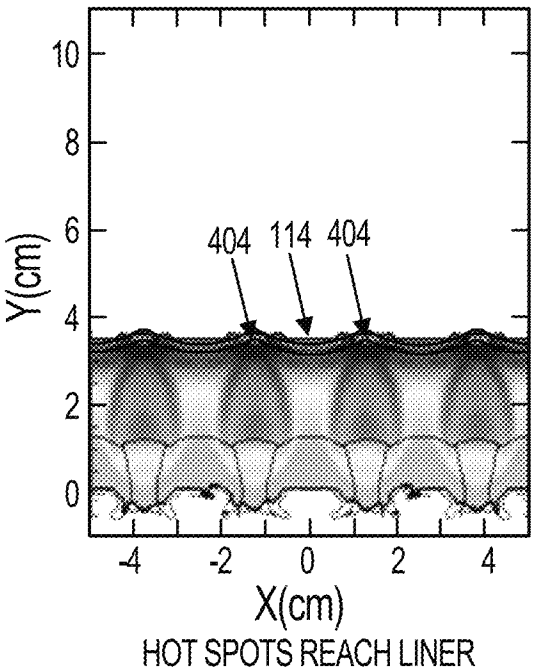
Figure 4J:
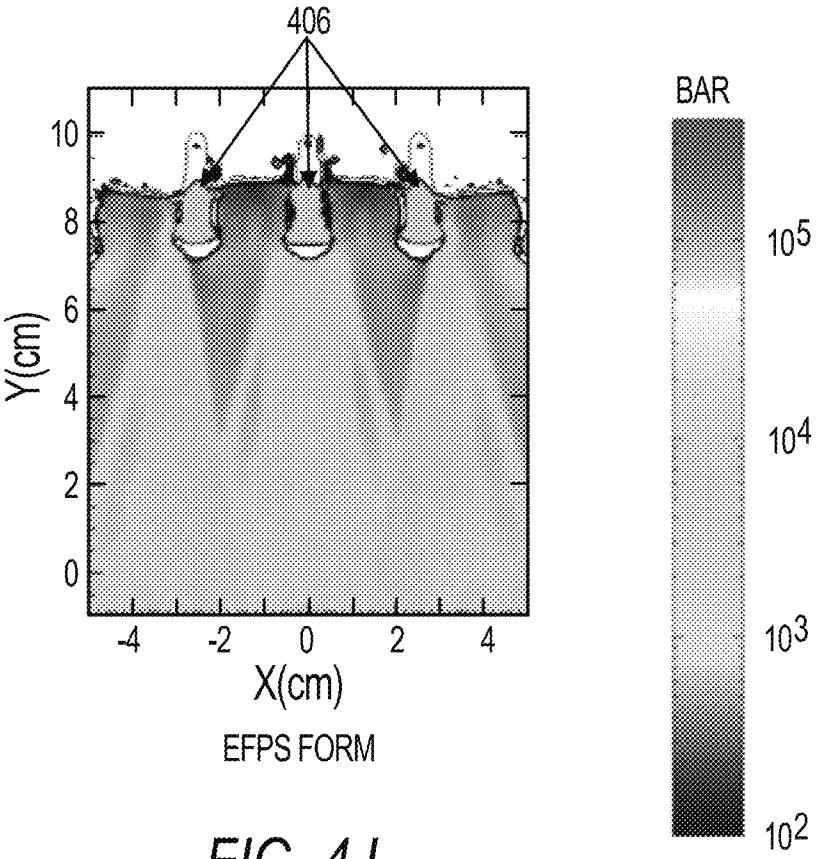
Figure 4I:
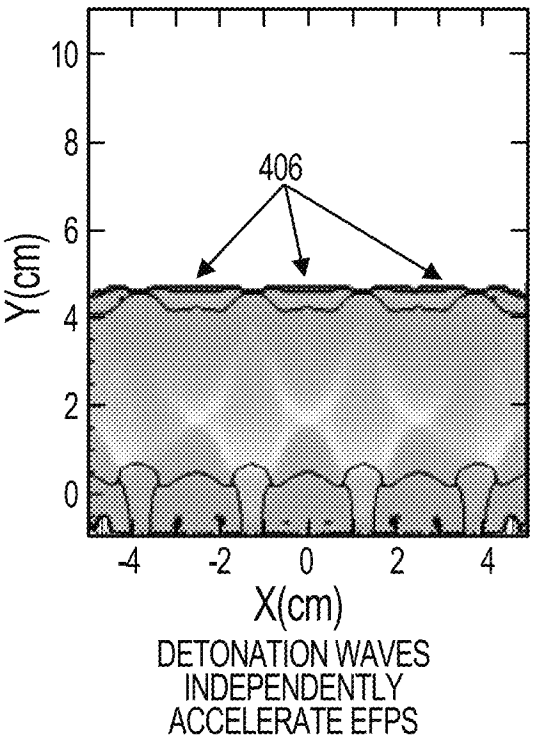
Figure 5A:
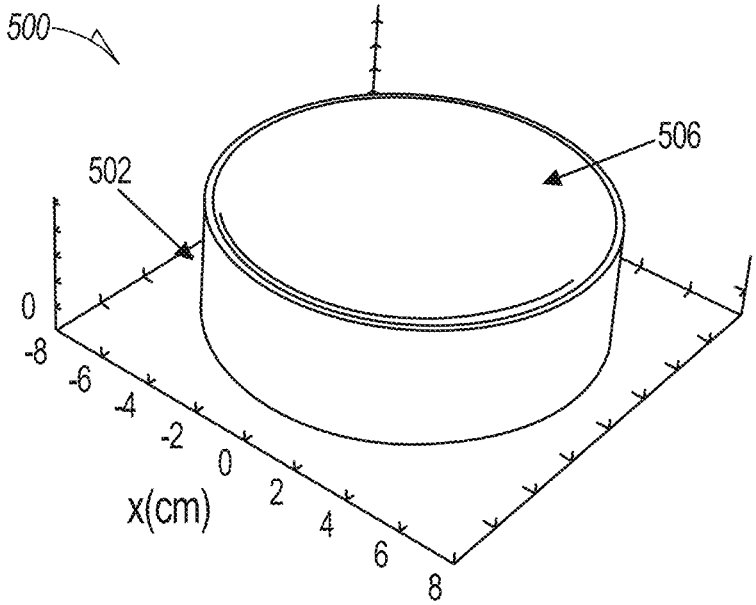
FIGS. 5A-5D are different views of another embodiment of a multiple EFP warhead in which the liner is a flat plate.
Figure 5B:
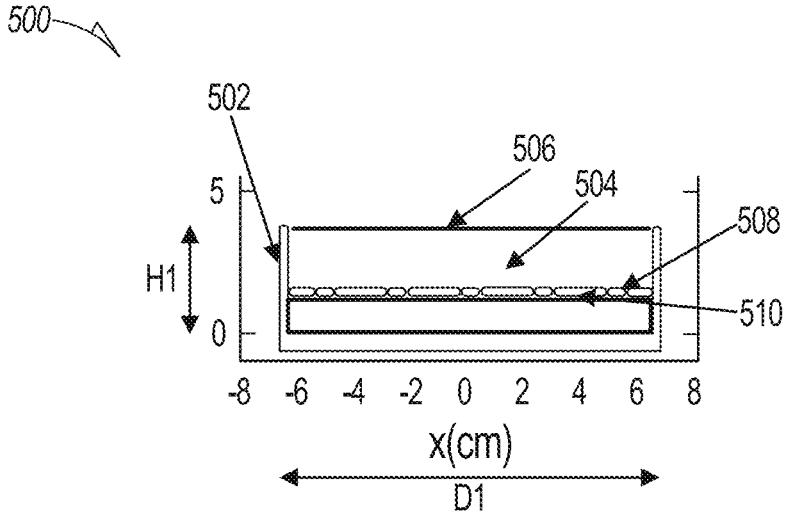
Figure 5C:
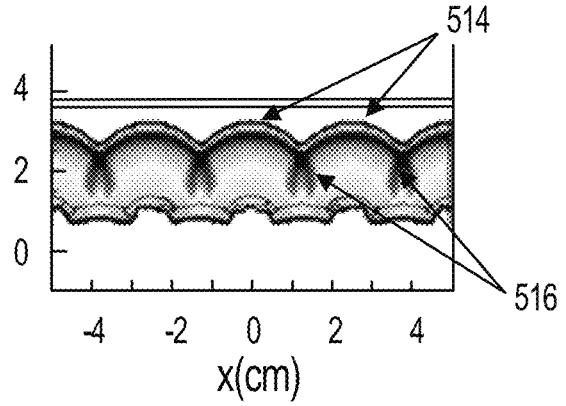
Figure 5D:
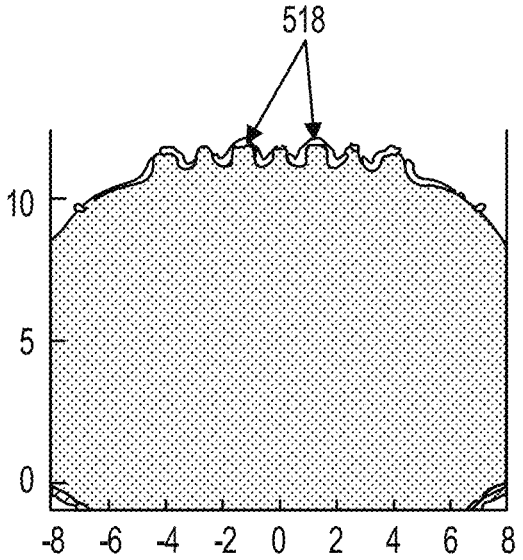

Referring now to FIGS. 3A-3B, in an embodiment, an initiation system 300 includes an inert housing 302 having a single point initiation site 304 and a plurality of tracks 306 that connect the single point initiation site to the plurality of booster charge sites 308. Explosive material 310 is placed in the plurality of tracks. A detonator 312 at the single point initiation site produces detonation waves that travel through the explosive material 310 in the tracks to the booster charge sites 308 initiate the plurality of booster charges. The plurality of tracks may be equal length to facilitate simultaneous initiation of the plurality of booster charges or different lengths to facilitate a patterned initiation of the plurality of booster charges.

Referring now to FIGS. 4A-4J, in an embodiment, the plurality of boosters 108 are simultaneously initiated by the initiation system to initiate booster waves 400 that continue forward within the booster charge sites 308 within the inert housing 110. Booster waves 400 transfer detonation to main charge 104 to form detonation waves 402 that propagate forward through main charge 104. As each detonation waves 402 constructively interferes with the directly adjacent detonation wave 402, hot spots 404 of elevated pressure are defined at multiple locations that are approximately aligned to the edges of dimples 114. As previously described, the hot spots 404 form within a distance range from the boosters. If the liner is too close to the boosters 108 that hot spots 404 will have not yet formed. If the liner is too far away, the plurality of detonation waves 402 will interfere and level off into a single planar wave. The front of each detonation wave 402 impacts the bottom of each dimple and then the hot spots 404 reach the liner at the edges of the dimples 114 and cut into the liner 106 to form multiple EFPS 406, one for each dimple 114. The detonation waves 402 independently accelerate and form each EFP 406, which are propelled forward.

Referring now to FIGS. 5A-5D, an embodiment of a multiple EFP warhead 500 includes a cylindrical housing 502 that contains a main charge 504, a liner 506 on a top surface of the main charge, a plurality of booster charges 508 in a booster housing 510 and spaced apart on a bottom surface of the main charge, and an initiation system 512. In this embodiment, liner 506 if a flat plate of suitably uniform thickness across the main charge. The "apex angle" of a flat plate being 180°. The spacing of booster charges 508 determines the number and size of the individual penetrators. Initiation system 512 is configured for multi-point initiation of the plurality of booster charges 508 to detonate the main charge 504 to produce a plurality of detonation waves 514 that constructively interfere at multiple locations (hot spots 516) on the back surface of the liner to cut the liner and to form and propel forward a plurality of (EFPs) 518. The elevated pressures at the multiple locations are between 110% and 200% of the detonation pressure at the front of an individual detonation wave. The formation of these hot spots 516 at what corresponds to the edges of the individual liners once cut is what allows a flat liner or plate to be formed into a penetrator. By comparison, if a plane wave were incident on the flat plate it would simply propel the flat plate forward. Within this "range", the warhead (liner, main charge, boosters and initiation system) has a height H1 along the axis and a diameter D1 across the axis, wherein $0.3 <= H1/D1 <= 0.6$.

The tradeoff of "dimples" vs "flat plate" is that the dimples tend to form more aerodynamic penetrators at a higher speed than penetrators cut from a flat plate. However, the flat plate is easier and less expensive to manufacture. Additionally, the boosters do not have to be precisely aligned as they do in the case of the dimpled liner. Furthermore, modifications to the number and size of the penetrators only requires redesign of the boosters, not the liner as is the case with the dimpled liner.

In comparison to existing MEFPs that produce a planar detonation wave to form the multiple EFPs, the current design requires a main charge with less height H2, hence less volume to form the elevated pressure hot spots. Furthermore, formation of the hot spots to cut the individual dimples or the flat plate produces penetrators that are better and more uniformly formed than a single planar detonation wave.

While several illustrative embodiments of the disclosure have been shown and described, numerous variations and alternate embodiments will occur to those skilled in the art. Such variations and alternate embodiments are contemplated, and can be made without departing from the spirit and scope of the disclosure as defined in the appended claims.

We claim:

1. A warhead, comprising:

a main charge;

a liner on a top surface of the main charge;

a plurality of booster charges spaced apart on a bottom surface of the main charge; and an initiation system configured for multi-point initiation of the plurality of booster charges to detonate the main charge to produce a plurality of detonation waves that constructively interfere at multiple locations on the back surface of the liner to cut the liner and to form and propel forward a plurality of explosively formed penetrators (EFPs);

wherein pairs of directly adjacent detonation waves produce the multiple locations in a non-planar wave within a distance range from the plurality of booster charges, wherein the liner is positioned within that distance range, wherein beyond that range interference of the plurality of detonation waves would form a plane wave.

2. The warhead of claim 1, wherein the warhead is oriented along an axis, wherein the warhead has a height H1 along the axis and a diameter D1 across the axis, wherein 0.3<=H1/D1<=0.6.

3. The warhead of claim 1, wherein the initiation system comprises:

an inert housing including a single point initiation site and a plurality of tracks that connect the single point initiation site to the plurality of booster charges;

explosive material in the plurality of tracks; and a detonator at the single point initiation site, wherein initiation of the detonator produces detonation waves that travel through the explosive material in the tracks to initiate the plurality of booster charges.

4. The warhead of claim 3, wherein the plurality of tracks are equal length to facilitate simultaneous initiation of the plurality of booster charges.

5. A warhead, comprising:

a main charge;

a liner on a top surface of the main charge;

a plurality of booster charges spaced apart on a bottom surface of the main charge; and an initiation system configured for multi-point initiation of the plurality of booster charges to detonate the main charge to produce a plurality of detonation waves that constructively interfere at multiple locations on the back surface of the liner to cut the liner and to form and propel forward a plurality of explosively formed penetrators (EFPs), wherein a pressure at the multiple locations is at least 110% a detonation pressure at the front of the detonation waves between the locations.

6. The warhead of claim 5, wherein the pressure at the multiple locations is up to 200% of the detonation pressure.

7. A warhead, comprising:

a main charge;

a liner on a top surface of the main charge, wherein the liner includes a flat plate;

a plurality of booster charges spaced apart on a bottom surface of the main charge; and an initiation system configured for multi-point initiation of the plurality of booster charges to detonate the main charge to produce a plurality of detonation waves that constructively interfere at multiple locations on the back surface of the liner to cut the liner and to form and propel forward a plurality of explosively formed penetrators (EFPs).

8. The warhead of claim 7, wherein the flat plate has uniform thickness across the main charge.

9. A warhead, comprising:

a main charge;

a liner on a top surface of the main charge, wherein the liner includes a plurality of dimples;

a plurality of booster charges spaced apart on a bottom surface of the main charge; and an initiation system configured for multi-point initiation of the plurality of booster charges aligned to the centers of the dimples to detonate the main charge to produce a plurality of detonation waves that constructively interfere at multiple locations on the back surface of the liner to cut the each dimple and to form and propel forward a plurality of explosively formed penetrators (EFPs).

10. The warhead of claim 9, wherein each dimple is thicker in the center and thinner towards the edges.

11. The warhead of claim 9, wherein the EFPs are stable in-flight over a range to target of at least 50× the diameter of the dimple.

12. The warhead of claim 9, wherein the warhead is oriented along an axis, wherein the main charge has a height H2 along the axis and a dimple diameter D2 across the axis, wherein 0.5<=H2/D2<=1.5.

13. The warhead of claim 12, wherein the warhead is oriented along an axis, wherein the warhead has a height H1 along the axis and a diameter D1 across the axis, wherein 0.3<=H1/D1<=0.6.

14. A warhead having a height H1 along an axis and a diameter D1, said warhead comprising:

a main charge having a height H2;

a liner on a top surface of the main charge, said liner having a plurality of dimples each having a diameter D2;

a plurality of booster charges spaced apart on a bottom surface of the main charge and aligned to centers of the plurality of dimples; and an initiation system configured for multi-point initiation of the plurality of booster charges to detonate the main charge produce a plurality of detonation waves that constructively interfere at multiple locations on the back surface of the liner at the edges of the dimples to cut the liner and to form the dimples into a plurality of explosively formed penetrators (EFPs) that are propelled forward wherein 0.3<=H1/D1<=0.6, and wherein 0.5<=H2/D2<=1.5.

15. The warhead of claim 14, wherein a pressure at the multiple locations between 110% and 200% of a detonation pressure at the front of the detonation waves between the locations.

16. The warhead of claim 14, wherein each dimple is thicker in the center and thinner towards the edges.

17. A warhead, comprising:

a main charge;

a liner on a top surface of the main charge;

a plurality of booster charges spaced apart on a bottom surface of the main charge; and an initiation system including an inert housing having a single point initiation site and a plurality of tracks that connect the single point initiation site to the plurality of booster charges, explosive material in the plurality of tracks and a detonator at the single point initiation site, wherein initiation of the detonator produces detonation waves that travel through the explosive material in the tracks to initiate the plurality of booster charges to detonate the main charge and produce a plurality of detonation waves that constructively interfere at multiple locations on the back surface of the liner at a pressure between 110% and 200% of a detonation pressure of a single detonation wave to cut the liner and to form and propel forward a plurality of explosively formed penetrators (EFPs).

18. The warhead of claim 17, wherein the liner includes a flat plate of uniform thickness.

19. The warhead of claim 17, wherein the liner includes a plurality of dimples, wherein the plurality of booster charges is aligned to the centers of the dimples such that each dimple is cut and formed into an EFP.

* * * * *